US006896071B1

(12) United States Patent
Collins

(10) Patent No.: US 6,896,071 B1
(45) Date of Patent: May 24, 2005

(54) DRIVE SYSTEMS AND METHODS FOR SHEET PILES

(76) Inventor: John Edward Collins, 387 Baker Way, Camano Island, WA (US) 98282

( * ) Notice: Subject to any disclaimer, the term of this patent is extended or adjusted under 35 U.S.C. 154(b) by 0 days.

(21) Appl. No.: 10/222,641

(22) Filed: Aug. 15, 2002

(51) Int. Cl.[7] ..... B23B 45/04; B23B 45/16

(52) U.S. Cl. ..... 173/1; 173/90; 173/135; 173/136

(58) Field of Search ..... 173/1, 90, 114, 173/135, 136, 138, 206

(56) References Cited

U.S. PATENT DOCUMENTS 482,540 A * 9/1892 Brown
913,014 A * 2/1909 Kafer
1,089,112 A * 3/1914 Coutant
2,330,575 A * 9/1943 Grauding
3,063,330 A * 11/1962 Dietrich
3,920,083 A * 11/1975 Makita
4,415,111 A * 11/1983 McHarrie et al.
4,436,452 A * 3/1984 Bodine
4,625,811 A * 12/1986 Tuenkers
5,392,866 A * 2/1995 White
5,653,556 A * 8/1997 White
5,803,672 A * 9/1998 Glass et al.
5,806,608 A * 9/1998 DuBois
6,213,373 B1 * 4/2001 Wakai

OTHER PUBLICATIONS

Rhino Tool Company; *Rhino Air Operated Post Drivers;* 2000; 4 pages; Rhino Tool Company; Kewanee, IL, U.S.A.

* cited by examiner

*Primary Examiner*—Rinaldi I. Rada
*Assistant Examiner*—Gloria R. Weeks
(74) *Attorney, Agent, or Firm*—Michael B. Schacht; Schacht Law Office, Inc.

(57) ABSTRACT

A drive system for driving a sheet pile member at a desired location in the ground. The drive system comprises a source of pressurized air, an actuator system defining a drive axis, and an adapter member. The actuator system comprises a housing assembly having an inlet port connected to the source of pressurized air and a piston member adapted to move along the drive axis relative to the housing assembly. The adapter member is rigidly connected to the housing assembly. The adapter member further defines at least a first pair of first and second guide slots. In use, the sheet pile member is arranged at the desired location. The adapter member is arranged such that the first and second guide slots at least partly receive portions of the sheet pile member. The pressurized air causes the piston member to move along the drive axis. The piston member impacts the sheet pile member as the piston member moves along the drive axis, thereby displacing the sheet pile member along the drive axis into the ground at the desired location.

28 Claims, 4 Drawing Sheets

DRIVE SYSTEMS AND METHODS FOR SHEET PILES

TECHNICAL FIELD

The present invention relates to systems and methods for driving sheet piles and, more particularly, to adapters that allow conventional pneumatic pile driving systems to be used to drive plastic or thin gauge metal sheet piles.

BACKGROUND OF THE INVENTION

Construction projects often require a metal or wooden pile to be driven into the earth. A number pile driving systems have been developed to assist in driving piles. Common pile driving systems include drop hammers, vibratory hammers, diesel hammers, and cable actuator systems. Pile driving systems often use a fluid such as hydraulic oil or air to transfer energy to the pile.

The present invention is of primary significance when applied to a class of pneumatic pile driving systems adapted to drive relatively small diameter piles, or posts, into the earth. For simplicity, this class of pile drivers will be referred to herein as post drivers, but it should be clear that members other than posts can be and have been driven using these systems.

Post drivers employ a housing, a piston, a chuck member, and a source of pressurized air. Pressurized air causes the piston to move up and down relative to the housing. The piston engages and drives the pile or post as the piston moves up and down. The chuck member is attached to the housing to facilitate the transfer of energy from the piston to the pile.

The chuck member is typically configured to adapt to the size and shape of the pile being driven. For example, wooden posts are driven by a chuck member defining a cylindrical chamber having an inner diameter slightly larger than the diameter of the post. Channel posts are made of bent steel defining a channel, and a chuck member for driving a channel post may have a projection adapted to fit within the channel defined by the post. Post drivers tend to be relatively small and lightweight and may conveniently be used by one or two people.

A special class of piles includes sheet piles. Sheet piles are typically corrugated sheets that are at least partly driven or buried in the ground. Low gauge sheet piles made of plastic or lightweight steel are often used to form an underground barrier or retaining wall. Typically, these low gauge sheet pile are buried by excavating a trench, placing the sheet pile in the trench, and then filling the trench with dirt.

While attempts have been made to develop chuck members in the form of clamps that attach post drivers to sheet piles, these systems have not been effective and are not widely used. One problem with these sheet pile clamps is that the clamp mechanism tends to absorb the energy of the piston; another problem is that the driving loads tend to be asymmetrically applied to the sheet pile, which causes the sheet to flex. Flexing of the sheet pile absorbs energy and may cause the sheet pile to bend, which may ruin the sheet pile.

The need thus exists for systems and methods for allowing post drivers to be effectively used to drive light gauge sheet piles.

RELATED ART

The Applicant is aware of a number of references related to the driving of elongate members.

Initially, a professional patentability search turned up a number of U.S. patents. The patents in the search may be divided into two basic categories. The first category contains patents that specifically relate to pile driving systems and methods. The second category relates to any type of tool having a hollow jig or alignment portion with a slotted end.

Referring initially to the patents in the first group, U.S. Pat. No. 4,625,811 to Tuenkers discloses a relatively straightforward and conventional system for driving a sheet pile. In this system, a clamp assembly rigidly attached to a vibratory device is secured to an upper edge of the pile. The clamp assembly ideally prevents movement of the vibratory assembly relative to the pile. The vibratory assembly itself employs counter-rotating weights that result in addition of vertical forces and subtraction of lateral forces to result in up-and-down movement. The vibratory forces are combined with the weight of system to drive the sheet pile into the earth.

U.S. Pat. No. 3,920,083 to Makita discloses a pile driving apparatus for cylindrical piles. This system also employs counter-rotating weights to create vertical vibratory forces. These vibratory forces are applied to the pile through a clamp assembly and l-shaped guide members that decouples movement of the vibratory assembly from movement of the pile assembly.

U.S. Pat. No. 4,436,452 to Bodine discloses the use of a sonic oscillator and a compliant steel beam member. The frequency of the oscillator is adjusted to create a standing wave in the compliant beam member. The beam member is in turn attached to a pile upper end such that the vibratory forces created by the standing wave are applied to the pile upper end. The pile clamp assembly is decoupled from the compliant member such that the compliant member impacts the clamp assembly to drive the pile.

Turning now to the patents in the second category, these patents are disclosed only as background art.

U.S. Pat. No. 5,392,866 to White discloses a system intended to drive steel posts using a tractor.

U.S. Pat. No. 482,540 to Brown discloses a hand nailing tool employing a plunger and sleeve to drive nails. In one embodiment, the sleeve is slotted at its lower end so that the tool may be used to drive staples.

U.S. Pat. No. 913,014 to Kafer discloses a staple driver similar in construction to the device disclosed in the Brown '540 patent. In particular, the Kafer device employs a sleeve and a plunger. The plunger has a head on its lower end with a slot adapted to support the staple prior to driving.

U.S. Pat. No. 2,330,575 to Grauding discloses a tool having a hollow sleeve and a plunger. A spring is located within the sleeve to return the plunger to its upper position. The tool is used for driving staples, nails, or other fasteners.

U.S. Pat. No. 3,063,330 to Dietrich discloses a nailing machine in which a nail is fed into a stationary track and then driven with a striker that slides relative to the track.

U.S. Pat. No. 4,415,111 to McHarrie et al. discloses a stapling device having a stationary sleeve that supports the staple and a plunger that moves within the sleeve to drive the staple.

U.S. Pat. No. 6,213,373 B1 to Wakai discloses a fastener system for walls. This system employs a stationary guide and a fastener that extends through the guide into a wall. A screw is then threaded through the guide and the wall into the portion that extends through the wall to form a secure attachment to the wall.

U.S. Pat. No. 1,089,112 to Coutant discloses a tool for driving staples having a stationary sleeve and a plunger. The sleeve is slotted at the end to support the staples.

In addition to the patents turned up in the professional patentability search, the Applicant is aware of a number of patents obtained by and products sold by American Piledriving Equipment. A number of these patents are similar to the Tuenkers patent in that they use counter-rotating weights to create a vibratory force and a clamping assembly to apply this vibratory force to a pile. Often, these piles are solid cylindrical members such as concrete or wood, but in some situations, these piles are hollow cylindrical members referred to as caissons. Systems for driving caissons, such as those shown in U.S. Pat. No. 5,653,556, employ slotted clamps adapted to engage opposing portions of a caisson. These systems do not use air hammers with a piston member that drives a light gauge sheet pile.

The Applicant has also become aware of U.S. Pat. No. 5,803,672 to Glass et al. This patent discloses a system for driving sheet pile using a clamp assembly secured to the sheet pile. A vibratory hammer is in turn secured to the clamp assembly. The hammer drives the sheet pile through the clamp assembly. When the pile is fully driven, a hydraulic actuator is operated to break the clamp assembly from the sheet pile. This patent does not disclose the use of an air hammer having a piston member for driving a light gauge sheet pile.

SUMMARY OF THE INVENTION

The present invention is a drive system for driving a sheet pile member at a desired location in the ground. The drive system comprises a source of pressurized air, an actuator system defining a drive axis, and an adapter member. The actuator system comprises a housing assembly having an inlet port connected to the source of pressurized air and a piston member adapted to move along the drive axis relative to the housing assembly. The adapter member is rigidly connected to the housing assembly. The adapter member further defines at least a first pair of first and second guide slots. In use, the sheet pile member is arranged at the desired location. The adapter member is arranged such that the first and second guide slots at least partly receive portions of the sheet pile member. The pressurized air causes the piston member to move along the drive axis. The piston member impacts the sheet pile member as the piston member moves along the drive axis, thereby displacing the sheet pile member along the drive axis into the ground at the desired location.

DETAILED DESCRIPTION OF THE INVENTION

Figure 1:
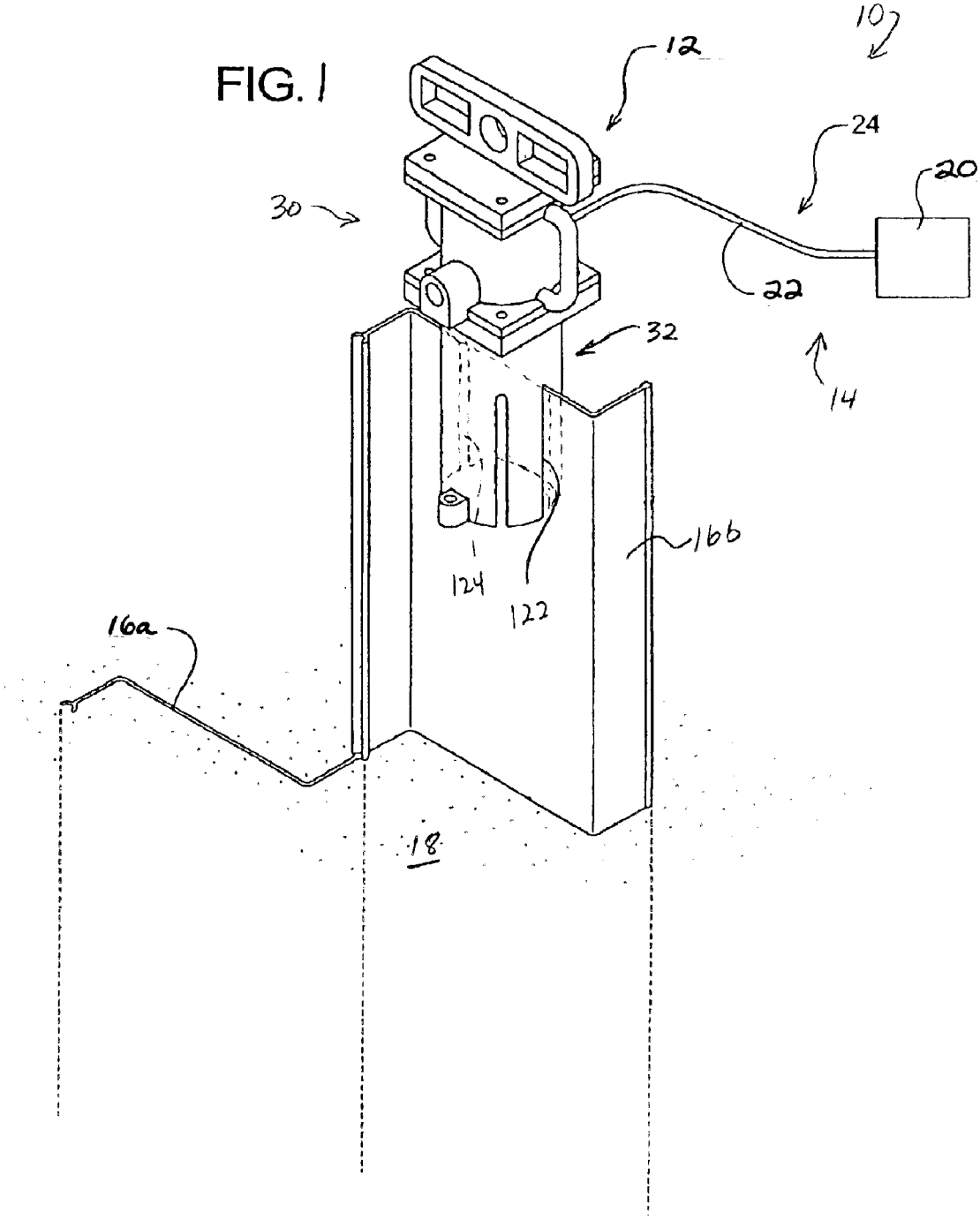
FIG. 1 is a perspective view of a sheet pile driver system of the present invention being used to drive conventional sheet pile.

Referring initially to FIG. 1, depicted at 10 therein is a sheet pile driver system constructed in accordance with, and embodying, the principals of the present invention. The sheet pile driver system 10 comprises a sheet pile driver assembly 12 and an air source 14. The exemplary system 10 is shown driving a sheet pile member 16*b* into the ground 18 adjacent to a previously driven pile member 16*a*.

The air source 14 is or may be conventional and comprises a compressor 20 and an air hose 22. The sheet pile members 16 also are or may be conventional and will also not be described herein in detail.

The system 10 operates basically as follows. The sheet pile driver member 12 is arranged on the sheet pile member 16 as shown in FIG. 1. The air source 14 is operated to supply pressurized air to the sheet pile driver assembly. When pressurized air is applied thereto, the sheet pile driver assembly drives the sheet pile driver into the ground 18.

FIG. 1 shows that the sheet pile driver assembly 12 comprises an actuator system 30 and an adapter member 32. The actuator system 30 and adapter member 32 will now be described in further detail with references to FIGS. 2–4. As perhaps best shown in FIG. 3, the actuator system 30 comprises a housing assembly 40 and a piston member 42.

The housing assembly 40 comprises a top plate member 50 and a cylinder member 52. Top and bottom flanges 54 and 56 are formed on the cylinder member 52 for reasons that will become apparent from the following discussion.

Figure 5:
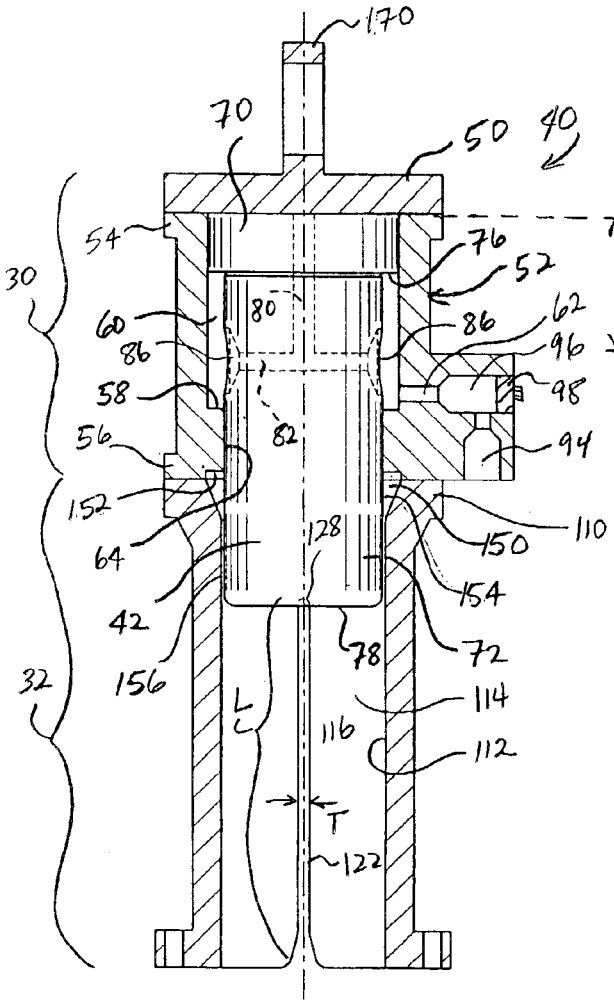
FIGS. 5–8 are vertical section views of the sheet pile driver assembly of FIG. 2 illustrating movement of a piston member relative to a housing assembly thereof.

As shown in FIG. 5, the cylinder member 52 defines a limit surface 58. In addition, the cylinder member 52 defines a head chamber 60. An inlet port 62 and shaft opening 64 are formed in the cylinder member 52 to allow fluid communication into and out of the head chamber 60 as will be described further below. Also, the piston member 42 is partly arranged within the head chamber 60 to define drive and lift portions 66 and 68 of the chamber 60.

More specifically, the piston member 42 defines a head portion 70 and a shaft portion 72. A drive surface 74 is formed on the head portion 70; the location of the drive surface 74 within the head chamber 60 defines the volume of the head chamber drive portion 66. The shaft portion 72 of the piston member 42 extends through the shaft opening 64 in the cylinder member 52. A lift surface 76 is formed on the head portion 70. The location of the lift surface 76 defines the volume of the head chamber lift portion 68. An impact surface 78 is formed on an end of the piston member 42 distal from the head portion 70.

In addition, FIG. 5 shows that the piston member 42 defines a supply chamber 80 and a feed chamber 82. The exemplary supply chamber 80 is in communication with the drive portion 66 of the head chamber 60 through a supply port 84. The feed chamber 82 is in fluid communication with the supply chamber and further defines a feed port 86.

Figure 6:
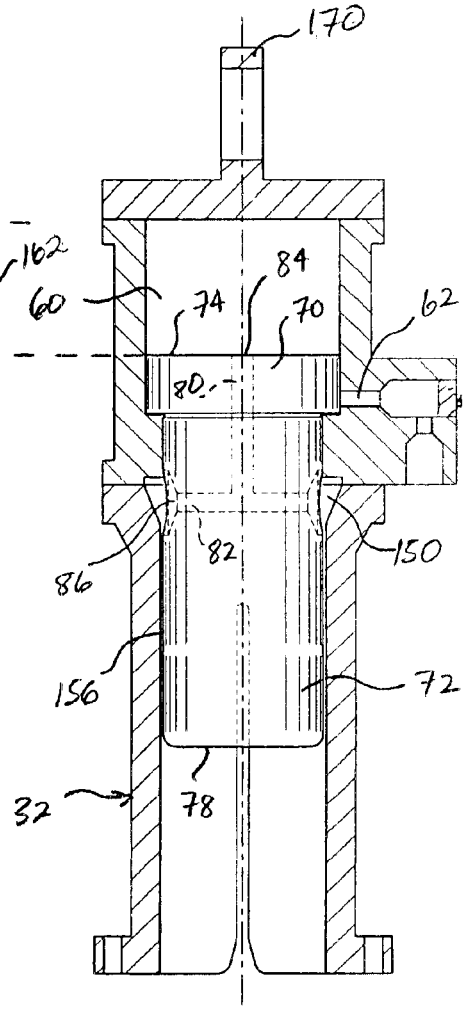

Referring now for a moment to FIGS. 5 and 6, a comparison of these figures illustrates that the piston member 42 moves between upper and lower positions relative to the housing assembly 40. As the piston member 42 moves relative to the housing assembly 42, the feed port 86 moves relative to the housing assembly 40 to define a passive valve system.

More specifically, as the piston member 42 moves relative to the housing assembly 40, the feed port 86 allows fluid to flow between the inlet port 62 and the drive portion 62 of the head chamber 60, prevents fluid flow into the head chamber 60, and allows fluid flow between the head chamber drive portion 62 and the exterior of the head chamber 60 as will be described further below. The purpose of this passive valve system will also be described in further detail below.

Figure 2:
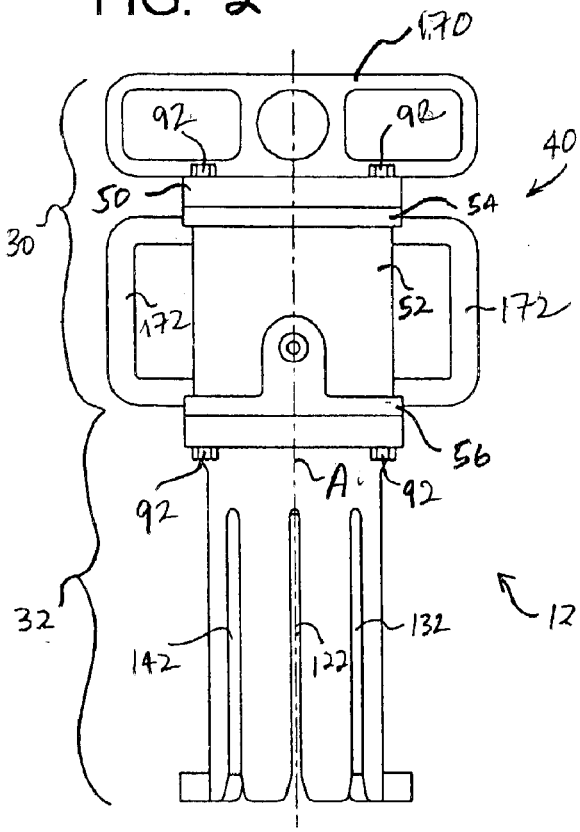
FIG. 2 is a front elevational view of a sheet driver assembly forming a part of the sheet pile driver system shown in FIG. 1.
Figure 3:
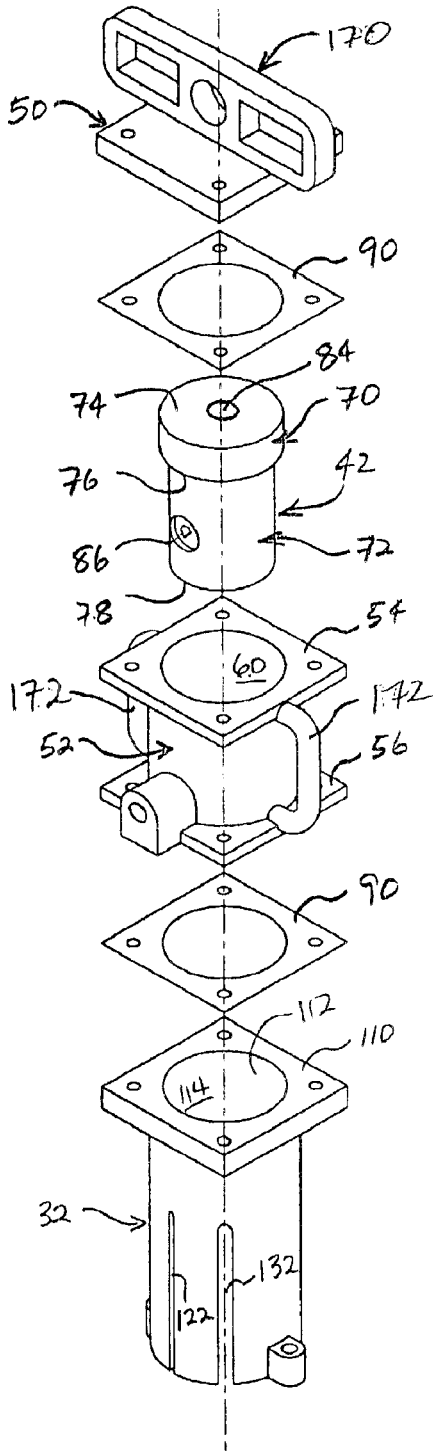
FIG. 3 is an exploded view of the sheet pile driver assembly of FIG. 2.

FIGS. 2, 3 and 5 illustrate how the actuator system 30 is assembled. First, with the top plate member 50 removed from the cylinder member 52, the piston member 42 is displaced such that the shaft portion 72 thereof extends through the shaft opening 64 in the cylinder member 52 with the head portion 70 of the piston member within the head chamber 60. The top plate member 50 is then secured to the top flange 54 of the cylinder member 52 to define the head chamber 60. A gasket 90 is arranged between the top plate member 50 and the top flange 54 to seal the head chamber 60. Bolt assemblies 92 secure the top plate member 50 to the top flange 54 of the cylinder member 52.

In addition, the exemplary cylinder member 52 defines first and second access ports 94 and 96. The air hose 22 is connected to one of these ports 94 and 96 to create a source of pressurized air at the inlet port 62. A plug 98 is provided to close the unused one of the first and second access ports 94 and 96.

The actuator system 30 can operate independently of the adapter member 32, but for purposes of clarity the operation of the actuator system 30 will be discussed below with reference to the operation of the sheet pile driver assembly 12.

Referring again to FIGS. 2–5, the adapter member 32 will now be discussed in further detail. The adapter member 32 comprises an attachment plate 110 that allows the adapter member 32 to be rigidly connected to the actuator system 30 using bolt assemblies 92. The adapter member 32 further defines an inner wall 112 defining a guide chamber 114. An impact portion 116 of the guide chamber 114 will be defined in further detail below.

Figure 4:
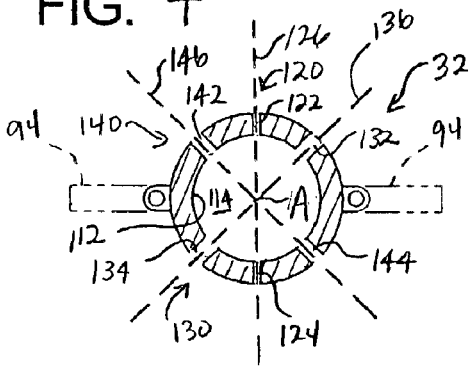
FIG. 4 is a bottom plan view of an adapter member of the sheet pile driver assembly of FIGS. 2 and 3.

Referring more specifically to FIG. 4 of the drawing, depicted therein is a first guide slot pair 120 comprising a first guide slot 122 and a second guide slot 124. The exemplary guide slots 122 and 124 are formed in opposing portions of the adapter member 32. The guide slots 122 and 124 define a thickness dimension "t" and a length "l". The guide slots 122 and 124 of the first guide slot pair have the same thickness "t" and length "l".

As shown in FIG. 1, the first and second guide slots 122 and 124 of the first guide slot pair 120 receive the pile member 16*b*. In particular, the adapter member 32 is arranged such that the first and second guide slots 122 and 124 at least partly receive portions of the sheet pile member 16*b*. In addition, FIGS. 4 and 5 illustrate the full range of movement allowed by the piston member 42 relative to the housing assembly 40. The length "l" of the guide slots 122 and 124 is such that the impact surface 78 of the piston member 42 is below an upper end 128 of the first guide slot 122 throughout the full range of motion of the piston member 42 relative to the housing assembly 40. This geometry allows contact between the piston member 42 and the sheet pile member 16*b* as the piston member 42 moves relative to the housing assembly 40.

FIG. 4 further shows that the exemplary adapter member 32 comprises a second guide slot pair 130 comprising a third guide slot 132 and fourth guide slot 134. The third and fourth guide slots 132 and 134 define a second guide slot reference plane 136.

The exemplary adapter member 32 further comprises a third guide slot pair 140 comprising a fifth guide slot 142 and sixth guide slot 144. Again, the fifth and sixth guide slots 142 and 144 define a third guide slot reference plane 146.

As shown in FIG. 3, the guide slots 122 and 124, 132 and 134, and 142 and 144 are formed such that the reference planes 126, 136 and 146 intersect at a drive axis A as will be described in further detail below.

Although the length "l" of the guide slots defining the first, second, and third guide slot pairs 120, 130, and 140 are equal, the thickness dimension "t" of these various slots will typically be different. Varying this thickness dimension "t" allows the sheet pile driver assembly 12 to accommodate sheet pile members 16 of differing materials and thicknesses.

Bolt assemblies 90 are used to rigidly connect the attachment plate 110 to the bottom flange 56 of the cylinder member 52. A gasket 90 is arranged between the bottom flange 56 and the attachment plate 110 to prevent flow of fluid therebetween.

With the adapter member 32 attached to the housing assembly 40 as just described, an outlet chamber 150 is formed. In particular, an outlet recess 152 in the cylinder member 52 around the shaft opening 64 and an outlet notch 154 formed on the adapter member 32 define the outlet chamber 150. An exhaust gap 156 is defined between the shaft portion 72 of the piston member 42 and the inner wall 112 of the adapter member 32.

With the foregoing construction of the sheet pile driver assembly 12 in mind, the operation of this assembly 12 will now be described in further detail.

Referring initially to FIGS. 5 and 6, it can be seen that the bolt assemblies 92 secure the adapter member 32 to the housing assembly 40 to form a rigid structural assembly 160 under normal operating conditions. The piston member 42 moves relative to the structural assembly 160 between first and second extreme positions as shown in FIGS. 5 and 6, respectively. In the first extreme position, the drive surface 84 comes into contact with the top plate member 54. In the second extreme position, the lift surface 76 comes into contact with the limit surface 58. Reference character 162 illustrates a first range of movement defined between these first and second extreme positions.

Figure 8:
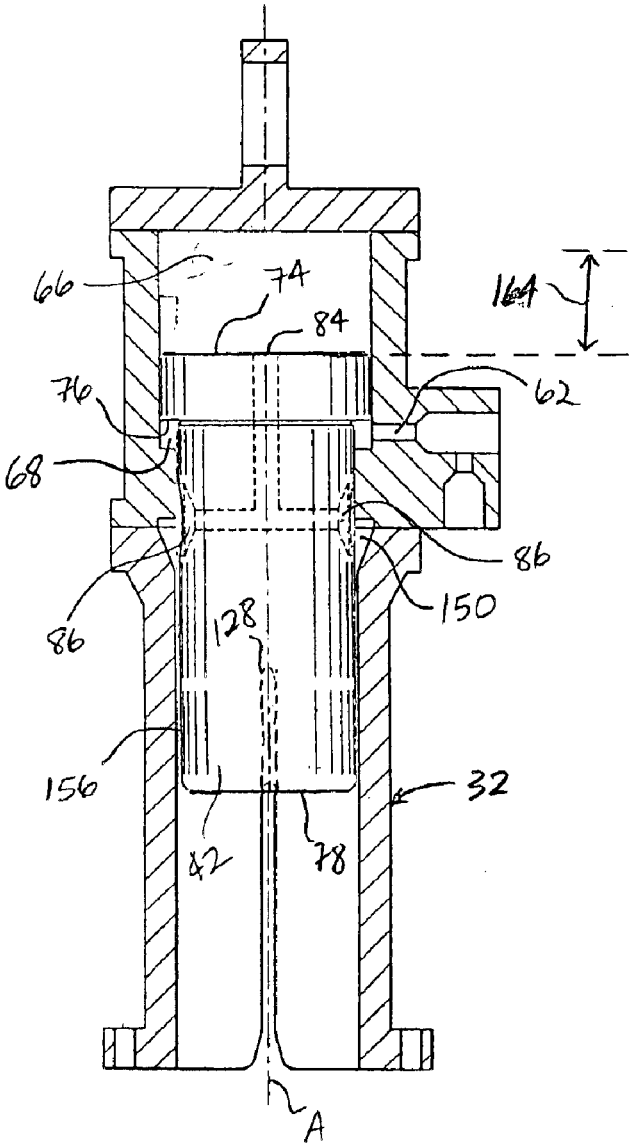
Figure 7:
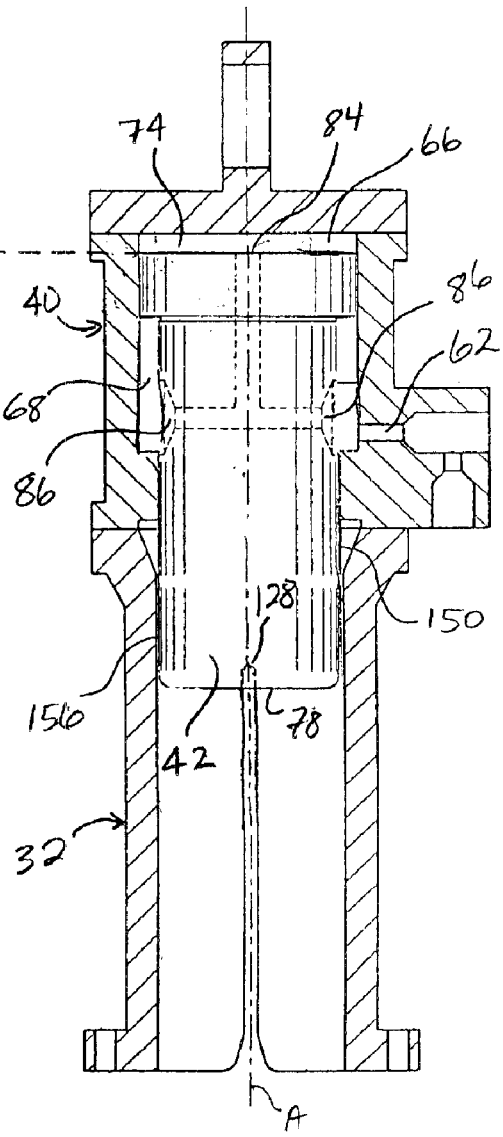

However, FIGS. to FIGS. 7 and 8 illustrates that, during normal use, the piston member 42 moves between first and second operating positions, respectively. In the first and second operating positions, the piston head portion 70 does not come into direct contact with the housing assembly 40.

In the first operating position depicted in FIG. 7, the feed port 86 is arranged within the lift portion 68 of the head chamber 60. Pressurized air at the inlet port 62 thus flows through the feed port 86, the feed chamber 82, the supply chamber 80, and out of the supply port 84 and into the drive portion 66 of the head chamber 60. Air so introduced into the drive portion 66 of the head chamber 60 acts on the drive surface 74 of the piston member 42 to cause the piston member 42 to move relative to the housing assembly 40 from the first operating position towards the second operating position.

As the piston member 42 is forced towards the second operating position, the feed port 86 is displaced out of the head chamber 60. Pressurized air thus no longer flows into the drive portion 66 of the head chamber 60 once the feed port is displaced out of the head chamber 60.

As the piston member 42 moves further towards the second operating position, the feed port 86 aligns with the outlet chamber 150. With the feed port 86 aligned with the outlet chamber 150, pressurized air within the drive portion 66 of the head chamber 60 may flow back through the supply port 84, the supply chamber 80, the feed chamber 82, and out of the feed port 86 into the outlet chamber 150. Pressurized air within the outlet chamber 150 passes through the exhaust gap 156 into the surrounding environment.

At the same time, pressurized air at the inlet port 162 is introduced into the lift portion 68 of the head chamber 60. Pressurized air within the lift portion 68 of the head chamber 60 acts on the lift surface 76 on the piston member 42.

Because the air within the lift portion 68 is at a higher pressure than the air within the drive portion 66, the piston member 42 stops at the second operating position and begins to move back towards the first operating position.

As the piston member 42 approaches the first operating position, the feed port 86 is initially blocked such that air is trapped within the drive portion 66 of the head chamber 60. Momentum causes the piston member 42 to continue to move upward, there by compressing the air trapped in the drive portion 66. As this trapped air compresses, and movement of the piston member 42 is slowed. As the piston member 42 continues to move towards the first operating position., the feed port 86 again comes into fluid communication with the head chamber 60. At this point, fluid is again allowed to flow into the drive portion 66 of the head chamber 60. The pressurized air within the drive portion 66 creates a pressure differential that eventually stops the piston member 42 at the first operating position. The cycle then repeats as long as pressurized air is present at the inlet port 62.

As shown in FIGS. 7 and 8, the impact surface 78 is below the upper end 128 of the guide slots 122 throughout the entire operating cycle. Accordingly, while the guide slots support the structural assembly 160 such that the piston member 42 is arranged above the sheet pile member 16, the guide slots 122 and 124 do not interfere with contact between the piston member 42 and the sheet pile member 16.

In use, the piston member 42 moves within a second range of movement 164 defines by the drive surface 74 in the first and second operating positions. The second range of movement is smaller than, and within, the first range of movement 162 defined above.

While the exact geometry of the adapter member 32, housing assembly 40, and piston member 42 is not critical to a particular implementation of the present invention, it is desirable that the center of gravity of the sheet pile driver assembly 12 be generally aligned along the drive axis A as defined above. In particular, the longitudinal axes of the adapter member 32, piston member 42, and cylinder member 52 are all aligned with each other and with the drive axis A.

Referring for a moment back to FIGS. 1–4, it can be seen that the exemplary sheet pile driver assembly 12 comprises a top handle 170 and side handles 172. These handles allow the sheet pile driver assembly 12 to be transported easily and steadied during use.

Giving the foregoing, it should be apparent to one of ordinary skill in the art that the present invention may be modified in forms other than those described above.

For example, although the exemplary adapter member 32 is generally cylindrical, other geometries such as square, may be used. In addition, although three guide slot pairs are used in the exemplary adapter member 32, one, two, four, or more guide slot pairs may be formed in other implementations of the present invention.

In addition, although the sheet pile driver assembly 12 is optimized when the length dimensions "l" of the guide slots allows contact between the piston member 42 and the sheet pile member 16 throughout the drive cycle, the present invention may be embodied in a system with shorter guide slots that allow the piston member to disengage from the sheet pile member as the piston member approaches the first operating position.

Accordingly, the scope of the present invention should be determined by the following claims and not the foregoing detailed discussion.

From the foregoing, it should be clear that the present invention may be embodied in forms other than those described above. The above-described systems are therefore to be considered in all respects illustrative and not restrictive, the scope of the invention being indicated by the claims appended hereto rather than the foregoing description. All changes that come within the meaning and scope of the claims are intended to be embraced therein.

What is claimed is:

1. A drive system for driving a sheet pile member at a desired location in the ground comprising:

a source of pressurized air;

an actuator system defining a drive axis, the actuator system comprising a housing assembly having an inlet port connected to the source of pressurized air; and a piston member adapted to move along the drive axis relative to the housing assembly; and an adapter member rigidly connected to the housing assembly, where the adapter member defines a plurality of pairs of guide slots and each pair of guide slots is configured to accommodate a different type of sheet pile member; whereby the sheet pile member is arranged at the desired location;

the adapter member is arranged such that the first and second guide slots at least partly receive portions of the sheet pile member;

the pressurized air causes the piston member to move along the drive axis; and the piston member impacts the sheet pile member as the piston member moves along the drive axis, thereby displacing the sheet pile member along the drive axis into the ground at the desired location.

2. A drive system as recited in claim 1, in which:

the piston member moves within a range of movement along the drive axis relative to the housing assembly; and the first and second guide slots are sized and dimensioned such that the adapter member allows contact between the piston member and the sheet pile member as the piston member moves within the range of movement.

3. A drive system as recited in claim 1, in which each of the pairs of guide slots is sized and dimensioned to accommodate a different thickness of sheet pile member.

4. A drive system as recited in claim 1, in which the adapter member defines:

a first pair of first and second guide slots;

a second pair of third and fourth guide slots; and a third pair of fifth and sixth guide slots.

5. A drive system as recited in claim 1, in which the slots in each pair of guide slots are formed in opposing portions of the adapter member.

6. A drive system as recited in claim 1, in which each pair of guide slots defines an associated guide slot reference plane, where the guide slot reference planes intersect at the drive axis.

7. A drive system as recited in claim 1, in which each pair of guide slots defines an associated guide slot reference plane, where the guide slot reference planes are angularly spaced from each other by at least thirty degrees.

8. A drive system as recited in claim 4, in which the first, second, and third pairs of guide slots define first, second, and third guide slot reference planes, respectively, where the first guide slot reference plane is spaced from the second and third guide slot reference planes by at least forty-five degrees.

9. A drive system as recited in claim 1, in which the actuator system further comprises at least one handle member secured to the housing assembly.

10. A method of driving a sheet pile member at a desired location in the ground comprising the steps of:

providing an actuator system defining a drive axis, the actuator system comprising a housing assembly having an inlet port connected to the source of pressurized air; and a piston member adapted to move along the drive axis relative to the housing assembly; and providing an adapter member;

forming a plurality of pairs of guide slots in the adapter member, where each pair of guide slots is configured to accommodate a different type of sheet pile member;

rigidly connecting the adapter member to the housing assembly to define a drive assembly;

arranging the sheet pile member at the desired location;

arranging the drive assembly such that the first and second guide slots at least partly receive portions of the sheet pile member; and introducing pressurized air into the inlet port of the housing assembly to cause the piston member to move along the drive axis such that the piston member impacts the sheet pile member and displaces the sheet pile member along the drive axis into the ground at the desired location.

11. A method as recited in claim 10, further comprising the steps of forming the guide slots such that the adapter member allows contact between the piston member and the sheet pile member as the piston member moves within a range of movement along the drive axis relative to the housing assembly.

12. A method as recited in claim 10, in which each of the pairs of guide slots is sized and dimensioned to accommodate a different thickness of sheet pile member.

13. A drive system for driving a sheet pile member at a desired location in the ground comprising:

a source of pressurized air;

an actuator system defining a drive axis, the actuator system comprising a housing assembly having an inlet port connected to the source of pressurized air; and a piston member adapted to move in a first predetermined range along the drive axis relative to the housing assembly; and an adapter member rigidly connected to the housing assembly, where the adapter member defines a plurality of pairs of guide slots; whereby the sheet pile member is arranged at the desired location;

the adapter member is arranged such that one of the plurality of pairs of guide slots at least partly receive portions of the sheet pile member;

the pressurized air causes the piston member to move in a second predetermined range along the drive axis, where the second predetermined range is within the first predetermined range;

the piston member impacts the sheet pile member as the piston member moves along the drive axis, thereby displacing the sheet pile member along the drive axis into the ground at the desired location; and the first and second guide slots are sized and dimensioned such that the adapter member allows contact between the piston member and the sheet pile member as the piston member moves within the second predetermined range.

14. A drive system for driving a sheet pile member at a desired location in the ground comprising:

a source of pressurized air;

an actuator system defining a drive axis, the actuator system comprising a housing assembly having an inlet port connected to the source of pressurized air; and a piston member adapted to move in a first predetermined range along the drive axis relative to the housing assembly; and an adapter member rigidly connected to the housing assembly, where the adapter member defines plurality of pairs of guide slots; whereby the sheet pile member is arranged at the desired location;

the adapter member is arranged such that each of the guide slots of a selected pair of guide slots at least partly receives at least a portion of the sheet pile member;

the pressurized air causes the piston member to move along the drive axis; and the piston member impacts the sheet pile member as the piston member moves along the drive axis, thereby displacing the sheet pile member along the drive axis into the ground at the desired location.

15. A drive system as recited in claim 14, in which each pair of guide slots is configured to accommodate a different type of sheet pile member.

16. A drive system as recited in claim 14, in which each pair of guide slots is sized and dimensioned to accommodate a different thickness of sheet pile member.

17. A drive system as recited in claim 14, in which each pair of guide slots defines an associated guide slot reference plane, where the guide slot reference planes intersect at the drive axis.

18. A drive system as recited in claim 14, in which each pair of guide slots defines an associated guide slot reference plane, where the guide slot reference planes are angularly spaced from each other by at least thirty degrees.

19. A drive system for driving a sheet pile member at a desired location in the ground comprising:

a source of pressurized air;

an actuator system defining a drive axis, the actuator system comprising a housing assembly having an inlet port connected to the source of pressurized air; and a piston member adapted to move along the drive axis relative to the housing assembly; and an adapter member rigidly connected to the housing assembly, where the adapter member defines a plurality of pairs of first and second guide slots, where each pair of guide slots is configured to accommodate a different type of sheet pile member; whereby the sheet pile member is arranged at the desired location;

the adapter member is arranged such that the first and second guide slots at least partly receive portions of the sheet pile member;

the pressurized air causes the piston member to move along the drive axis;

the piston member impacts the sheet pile member as the piston member moves along the drive axis, thereby displacing the sheet pile member along the drive axis into the ground at the desired location.

20. A drive system as recited in claim 19, in which each of the pairs of guide slots is sized and dimensioned to accommodate a different thickness of sheet pile member.

21. A drive system as recited in claim 19, in which each pair of guide slots defines an associated guide slot reference plane, where the guide slot reference planes intersect at the drive axis.

22. A drive system as recited in claim 19, in which each pair of guide slots defines an associated guide slot reference plane, where the guide slot reference planes are angularly spaced from each other by at least thirty degrees.

23. A drive system for driving a sheet pile member at a desired location in the ground comprising:

a source of pressurized air;

an actuator system defining a drive axis, the actuator system comprising a housing assembly having an inlet port connected to the source of pressurized air; and a piston member adapted to move along the drive axis relative to the housing assembly; and an adapter member rigidly connected to the housing assembly, where the adapter member defines a first pair of first and second guide slots;

a second pair of third and fourth guide slots; and a third pair of fifth and sixth guide slots; whereby the sheet pile member is arranged at the desired location;

the adapter member is arranged such that the first and second guide slots at least partly receive portions of the sheet pile member;

the pressurized air causes the piston member to move along the drive axis; and the piston member impacts the sheet pile member as the piston member moves along the drive axis, thereby displacing the sheet pile member along the drive axis into the ground at the desired location.

24. A drive system as recited in claim 23, in which the first, second, and third pairs of guide slots define first, second, and third guide slot reference planes, respectively, where the first guide slot reference plane is spaced from the second and third guide slot reference planes by at least forty-five degrees.

25. A drive system for driving a sheet pile member at a desired location in the ground comprising:

a source of pressurized air;

an actuator system defining a drive axis, the actuator system comprising a housing assembly having an inlet port connected to the source of pressurized air;

a piston member adapted to move along the drive axis relative to the housing assembly; and at least one handle member secured to the housing assembly; and an adapter member rigidly connected to the housing assembly, where the adapter member defines a plurality of pairs of guide slots; whereby the sheet pile member is arranged at the desired location;

the adapter member is arranged such that one of the plurality of pairs of guide slots at least partly receive portions of the sheet pile member;

the pressurized air causes the piston member to move along the drive axis; and the piston member impacts the sheet pile member as the piston member moves along the drive axis, thereby displacing the sheet pile member along the drive axis into the ground at the desired location.

26. A method of driving a sheet pile member at a desired location in the ground comprising the steps of:

providing an actuator system defining a drive axis, the actuator system comprising a housing assembly having an inlet port connected to the source of pressurized air; and a piston member adapted to move along the drive axis relative to the housing assembly; and providing an adapter member;

forming a plurality of pairs of first and second guide slots in the adapter member, where each pair of guide slots is configured to accommodate a different type of sheet pile member;

rigidly connecting the adapter member to the housing assembly to define a drive assembly;

arranging the sheet pile member at the desired location;

arranging the drive assembly such that the first and second guide slots of one of the plurality of pairs of guide slots at least partly receive portions of the sheet pile member; and introducing pressurized air into the inlet port of the housing assembly to cause the piston member to move along the drive axis such that the piston member impacts the sheet pile member and displaces the sheet pile member along the drive axis into the ground at the desired location.

27. A method of driving a sheet pile member at a desired location in the ground comprising the steps of:

providing an actuator system defining a drive axis, the actuator system comprising a housing assembly having an inlet port connected to the source of pressurized air; and a piston member adapted to move along the drive axis relative to the housing assembly; and providing an adapter member;

forming a plurality of pairs of first and second guide slots in the adapter member, where each of the pairs of guide slots is sized and dimensioned to accommodate a different thickness of sheet pile member;

rigidly connecting the adapter member to the housing assembly to define a drive assembly;

arranging the sheet pile member at the desired location;

arranging the drive assembly such that the first and second guide slots of one of the plurality of pairs of guide slots at least partly receive portions of the sheet pile member; and introducing pressurized air into the inlet port of the housing assembly to cause the piston member to move along the drive axis such that the piston member impacts the sheet pile member and displaces the sheet pile member along the drive axis into the ground at the desired location.

28. A method of driving a sheet pile member at a desired location in the ground comprising the steps of:

providing an actuator system defining a drive axis, the actuator system comprising a housing assembly having an inlet port connected to the source of pressurized air; and a piston member adapted to move along the drive axis relative to the housing assembly; and providing an adapter member;

forming a plurality of pairs of guide slots in the adapter member, each of the pairs of guide slots is sized and dimensioned to accommodate a different thickness of sheet pile member;

rigidly connecting the adapter member to the housing assembly to define a drive assembly;

arranging the sheet pile member at the desired location;

arranging the drive assembly such that the first and second guide slots at least partly receive portions of the sheet pile member; and introducing pressurized air into the inlet port of the housing assembly to cause the piston member to move along the drive axis such that the piston member impacts the sheet pile member and displaces the sheet pile member along the drive axis into the ground at the desired location.

* * * * *